United States Patent [19]

Stangeland

[11] 3,970,030

[45] July 20, 1976

[54] INTERNAL THRUST REVERSER

[75] Inventor: Maynard L. Stangeland, Calabasas, Calif.

[73] Assignee: Rockwell International Corporation, El Segundo, Calif.

[22] Filed: Sept. 25, 1975

[21] Appl. No.: 616,748

[52] U.S. Cl. ..... 115/12 R; 115/14; 239/265.31

[51] Int. Cl.[2] ..... B63H 11/10

[58] Field of Search ..... 115/11, 12 R, 14, 16, 115/42; 114/151; 239/265.27, 265.29, 265.31; 60/221, 222, 229

[56] References Cited

UNITED STATES PATENTS

| | | | |
|---|---|---|---|
| 2,797,659 | 7/1957 | Haase et al. | 60/222 |
| 3,266,242 | 8/1966 | Aschauer | 115/12 R |
| 3,857,355 | 12/1974 | Woodfill | 115/12 R |

FOREIGN PATENTS OR APPLICATIONS

| | | | |
|---|---|---|---|
| 723,160 | 2/1955 | United Kingdom | 60/229 |
| 14,631 | 9/1905 | United Kingdom | 115/12 R |

*Primary Examiner*—Stephen G. Kunin
*Assistant Examiner*—Charles E. Frankfort
*Attorney, Agent, or Firm*—L. Lee Humphries; Robert G. Upton

[57] ABSTRACT

An internal thrust reverser duct is utilized in a water-jet pump design which comprises a center pintle body concentric with an outer housing forming an annular passage thereby downstream of an inducer. To divert the flow upstream of the nozzle plane in this configuration passage, a simple device that does not cause a significant loss in efficiency is required. A nozzle plate is axially moved closer to the pintle which simultaneously diverts the flow into an annularly exposed volute positioned upstream of the movable nozzle. The flow is diverted symmetrically and uniformly into the internal reversing duct. The velocity head is not lost in either of the flow that enters the volute or the flow that continues to pass through the movable nozzle.

6 Claims, 4 Drawing Figures

INTERNAL THRUST REVERSER

BACKGROUND OF THE INVENTION

1. Field of the Invention

This invention relates to waterjets in general and waterjet thrust reversing apparatus in particular.

2. Description of the Prior Art

The following prior art patents depict a cross section of the closest prior art now available to the patentee.

U.S. Pat. No. 454,151 to Bowring describes an apparatus wherein the discharge nozzle is square in cross section without a centerbody or pintle. The square cross section permits diverting the flow with a simple rectangular flapper hinge plate that swings into the flow stream. The apparatus has been used in many prior art devices where moving or diverting any substance is involved, such as water in a waterjet propulsion device.

U.S. Pat. No. 3,834,342 to Schoell describes a device where again, the discharge passages are rectangular in cross section, thereby permitting the use of a hinged-type flapper plate. The jet is diverted by moving the curved flappers into the jet downstream of the nozzle exit which is typical of most thrust vectoring or thrust reversing waterjet devices.

A third U.S. Pat. No. 3,269,663 to Strobl describes mixing and diverting of a primary flow and secondary flow of a by-pass flow gas turbine, the flow is diverted upstream of the nozzle plane by swinging a flat plate from one position to another position which closes the forward thrust passage and opens the diversion passage. To accomplish this with a flapper, a large mixing chamber space is required. This is a low efficiency device in that the velocity head entering the mixing chamber is lost and not recovered when the fluid dumps into the mixing chamber.

The instant invention discharges the waterjet flow forward along the side wall of a watercraft. Additionally, the present invention provides an internal thrust reverser having a lower friction loss than the state-of-the-art typical thrust reverser in that turning of the flow is conducted at low velocities before accelerating the flow to the nozzle exit velocity. The present invention provides internal thrust reversing apparatus which consists of diverting the flow into a collector volute upstream of the nozzle by moving a movable plate into the flow stream and closing the nozzle passage. The flow passes from the collector volute through a fixed duct and is discharged in the forward direction to provide for reverse thrust.

SUMMARY OF THE INVENTION

It is an object of this invention to provide a means to reverse a waterjet to provide rearward thrust for a watercraft.

More specifically it is an object of this invention to provide a thrust reversing device that discharges the waterjet flow forward along the side wall of a watercraft, the reversing duct being positioned internally of the watercraft.

An internal thrust reverser for waterjet driven craft is comprised of an outer housing member having a concentric inner pintle body spaced from the outer housing, the inner pintle body is supported by two or more flow straightener vanes downstream of an inducer pump, the vanes being equidistantly positioned and radially disposed between an inner wall of the outer housing and an outer wall of the pintle, the inner and outer wall forming an annular chamber thereby, the pintle body terminating in a cone-shaped end downstream of the flow straighteners.

A collector volute is connected to the outer housing, the volute having at least one reversing conduit attached thereto and positioned internally of the watercraft, the duct exiting through a wall of the watercraft through an exit orifice formed in the wall, the volute is positioned downstream of the flow straightener vanes, the volute being substantially radially disposed with respect to an axis of the pump, the volute forming an inwardly facing opening which communicates with the annular chamber.

A movable nozzle member is positioned adjacent the collector volute, the movable nozzle member is axially slidable within the outer housing member, a first upstream end of the nozzle member having an end face, the surface of the face being designed to seal and mate with the cone-shaped end of the inner concentric body, when the movable nozzle member is positioned in a forward position, fluid flow is blocked from entering the nozzle and diverted through the opening in the volute into the reversing duct, the first upstream end further forming a peripheral sealing lip that closes off the opening in the volute when the movable nozzle is positioned in a rearward forward thrust position, thus diverting all of the fluid through the nozzle. The nozzle is manipulated either mechanically, electro-mechanically or hydraulically to axially position the movable nozzle in a forward reverse thrust position or a rearward forward thrust position or any position therebetween.

The internal thrust reverser diverts the flow passing through an annular chamber formed by an outer pump housing and a concentric inner pintle type body positioned downstream of an inducer pump into a collector volute that is positioned upstream of a nozzle. A movable nozzle plate in its rearward position closes off the opening to the collector volute, thereby allowing the flow of fluid to pass normally through the pump and out through the nozzle to develop forward thrust. When the movable nozzle is positioned axially forwardly so that the upstream lip of the nozzle is engaged with the end of the inner pintle body, the flow of the fluid through the pump is directed into the collector volute and out through the reversing duct positioned internally of the watercraft. The movable nozzle plate or ring may be placed in a neutral position whereby the nozzle is moved axially forwardly into the fluid stream through the pump, thereby diverting half of the fluid to the reversing duct and allowing the other half of the fluid to escape through the nozzle opening.

The internal thrust reverser has lower frictional losses than the typical thrust reverser in that turning of the flow is conducted at low velocities before being accelerated through the throat normally formed by the nozzle.

Typically thrust reversing devices are positioned downstream of the nozzle opening whereby a reversing bucket is driven down into the stream accelerated through the nozzle and is diverted in a rearwardly position.

Therefore an advantage over the prior art is that the reversing duct is positioned internally of the watercraft, thereby preventing any possibility of the duct becoming damaged or fouled with debris or ice. Most of the state-of-the-art reversing devices are vulnerable to these conditions since they are positioned externally of the watercraft.

Still another advantage over the prior art is that the reversing collector volute interrupts the flow at a lower velocity than at the nozzle exit. Ordinarily a reversing bucket traps the accelerated fluid downstream of the nozzle.

Yet another advantage over the prior art is that the internal reversing duct may be so positioned to discharge the waterjet flow forward along the side wall of the watercraft. This normally would be impractical with state-of-the-art reversing buckets due to the nature of their design.

The above-noted objects and advantages of the present invention will be more fully understood upon a study of the following detailed description in conjunction with the detailed drawings.

DESCRIPTION OF THE PREFERRED EMBODIMENTS

Figure 1:
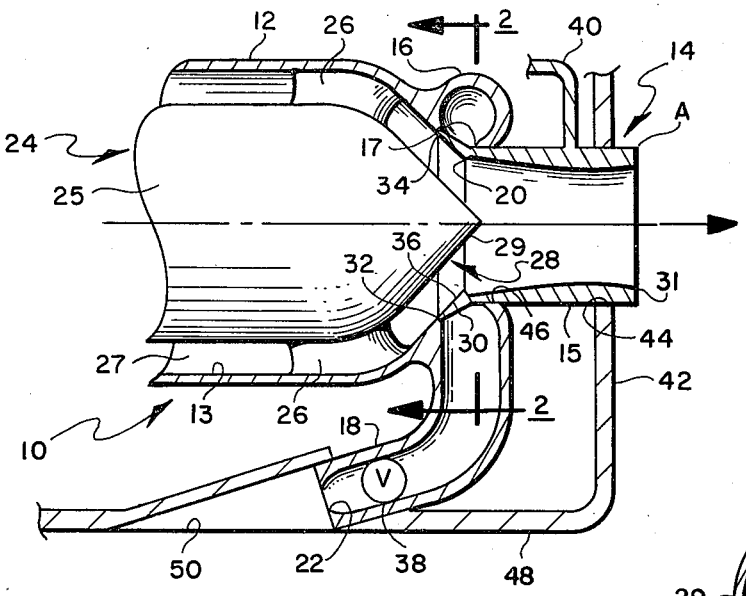
FIG. 1 is a schematic cross section of a portion of a waterjet pump showing the slidable nozzle in the open position allowing the water to exit normally through the nozzle.

Referring now to FIG. 1, a waterjet pump generally designated as 10 is comprised of an outer pump housing 12 and an inner concentric or pintle body 24. The outer wall 25 of pintle 24 and the inner wall 13 of housing 12 form an annular chamber 27. The pintle is supported by a series of flow straighteners 26 equidistantly and radially disposed between the pintle 24 and housing 12. The pintle terminates in a conically-shaped end generally designated as 28. A collector volute ring 16 is connected to housing 12 downstream of the flow straighteners 26. Volute 16 has an opening 17 that communicates with annular chamber 27 when a movable or slidable nozzle, generally designated as 14 is positioned axially forwardly into the flow stream passing through annulus 27. Nozzle 14 has an upstream end 30 forming a lip and a downstream exit end 31.

The movable nozzle member 14 (shown in position A) is axially slidable within volute 16. The outer surface 15 of nozzle 14 slides within the inner surface 46 of volute 16. The upstream end 30 of the nozzle has a sealing face 36 which is designed to seal with and mate to the conically-shaped end 28. When the nozzle 14 is positioned axially forwardly, sealing face 36 of end 30 mates with surface 29 of end 28. When the slidable nozzle 14 is so positioned, all of the water or fluid that is passing through annular chamber 27 is diverted into the volute collector ring 16 through opening 17. The volute 16 then directs the water into the reversing duct or conduit 18. The conduit 18 terminates within opening 50 which could be, for example formed within the side wall 48 of a watercraft.

When the nozzle ring 15 is in its rearward position, the rearward end 31 of the nozzle 14 is projected beyond transom 42. At the opposite end 30 of the nozzle, the peripheral lip 32 of end 30 mates with an annular sealing surface 34 formed in volute 16, thus closing off opening 17 in volute 16, thereby allowing the waterjet to operate normally in a forward thrust direction.

Figure 2:
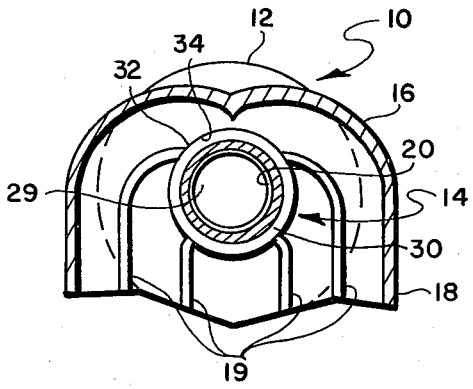
FIG. 2 is a section taken through line 2—2 of FIG. 1.

Referring to FIG. 2 volute 16 directs water into duct 18 toward exit 50. A series of flow straightener vanes 19 serve to break up turbulence as well as direct water through duct 18.

FIGS. 1 and 2 depict a reversing duct arrangement (looking down from the top on FIG. 1) that would, for example, direct water through duct 18 and out of the port side 48 past throat 22 and out exit orifice 50. This arrangement would direct water out of the port side of the watercraft above the water line, while an identical waterjet pump is parallel (not shown) would direct water through a reversing duct out of the starboard side of the watercraft.

It would be obvious to envision FIG. 1 as a side view with 48 being the bottom of the watercraft with exit 50 discharging water below the water line. This arrangement would be typical for a single waterjet pump powered craft.

It would similarly be obvious to have a pair of internal ducts 18 and 18' leading from volute 16 and exiting from the starboard and port side of the watercraft.

It would additionally be obvious to so arrange the reversing conduit or duct so that it is positioned externally of the watercraft.

Figure 3:
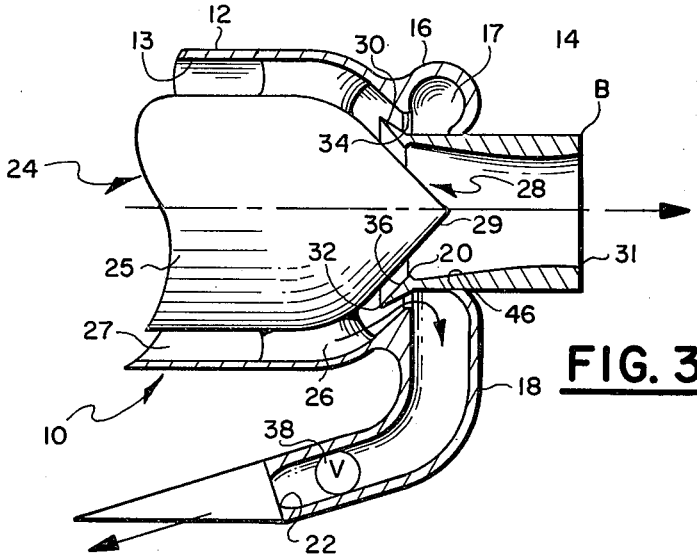
FIG. 3 is a schematic cross section of a waterjet pump illustrating the movable nozzle ring in an intermediate or neutral position, thus allowing water to pass both into the volute and through the nozzle.

A valve 38 may be positioned in the duct 18. With a valve so positioned it is then possible to permit the movable nozzle to act as a variable area device for forward thrust operation. For example, with reference to FIG. 3, with the nozzle in the B position and the valve 38 closed, the pump flow, jet velocity and the thrust may be varied by so positioning the nozzle axially with a constant pump horsepower. If the valve 38 were opened and the nozzle in the B position, the waterjet would be in neutral.

Figure 4:
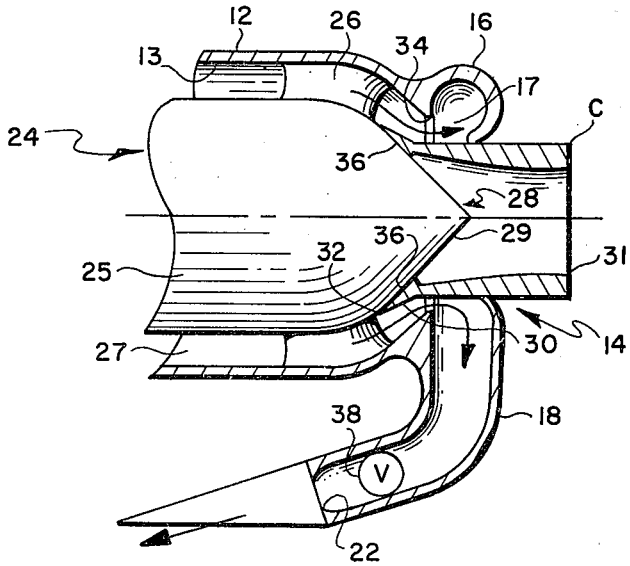
FIG. 4 is a schematic cross section showing the nozzle in the closed position thereby diverting all of the fluid into the water reversing duct.

FIG. 4 shows the movable nozzle in the forward C position mating face 36 with wall 29 of end 28 of the pintle. All of the water enters volute 16 through opening 17 into duct 18 for a full reverse thrust operation. With valve 38 closed the nozzle in the C position, the device may be secured during non-operation.

During startup, valve 38 may remain closed and the nozzle in the C position momentarily to prime aspirate the pump, thus minimizing the possibility of pump cavitation damage.

The movable nozzle ring 15 may be manipulated by mechanical or electromechanical or hydraulic means (not shown).

It will, of course, be realized that various modifications can be made in the design and operation of the present invention without departing from the spirit thereof. Thus, while the principal, preferred construction and mode of operation of the invention have been explained and what is now considered to represent its best embodiment has been illustrated and described, it should be understood that within the scope of the appended claims, the invention may be practiced otherwise than as specifically illustrated and described.

I claim:

1. An internal thrust reverser for waterjet driven craft comprising:

an outer housing member having a concentric inner pintle body spaced from said outer housing, said pintle body being supported by two or more flow straightener vanes downstream of an inducer pump, said vanes being equidistantly positioned and radially disposed between an inner wall of said outer housing and an outer wall of said pintle, said inner and outer wall forming an annular chamber therebetween, said pintle body terminating in a cone-shaped end downstream of said flow straighteners, a collector volute connected to said outer housing, said volute having at least one reversing conduit attached thereto, said volute is positioned downstream of said flow straightener vanes, said volute being substantially radially disposed with respect to a longitudinal axis of said pump, said volute forming an inwardly facing opening which communicates with said annular chamber, a movable nozzle member is positioned adjacent said collector volute, said movable nozzle member is axially slidable within said outer housing member, a first upstream end of said nozzle member having an end face, the surface of said end face mates with said cone-shaped end of said inner concentric pintle body, when said movable nozzle member is positioned in a forward reverse thrust position fluid flow is blocked from entering said nozzle and diverted through said opening in said volute into said reversing duct to reverse said watercraft, said first upstream end further forming a peripheral sealing lip that closes off said opening in said volute when said movable nozzle is positioned in a rearward forward thrust position, thus diverting all of the fluid through said nozzle, and means to axially manipulate said movable nozzle.

2. The invention as set forth in claim 1 further comprising a valve in said at least one reversing conduit, said valve when in the closed position enables the nozzle to perform as a variable area nozzle for forward thrust operation when said movable nozzle is manipulated between a forward and a rearward position.

3. The invention as set forth in claim 2 wherein said valve is closed and said movable nozzle is in a forward position, thus closing off both the nozzle and the reversing duct during non-operation.

4. The invention as set forth in claim 1 wherein said at least one reversing conduit is positioned internally of said watercraft, said conduit exiting through a wall of said watercraft through an exit orifice formed in said wall.

5. The invention as set forth in claim 1 wherein said first upstream end of said movable nozzle interrupts the flow through said annular chamber before said fluid reaches maximum velocity when said fluid passes by a throat formed by said movable nozzle when said nozzle is moved axially forwardly toward a fluid blocking position.

6. The invention as set forth in claim 1 wherein said collector volute divides into two reversing ducts, one of said reversing ducts leads to a port side of said watercraft, the other reversing duct leads to the starboard side of said watercraft, each of said ducts communicates with an exit orifice formed in port and starboard walls of said watercraft.

* * * * *